US007553197B2

(12) United States Patent
Mizutani

(10) Patent No.: US 7,553,197 B2
(45) Date of Patent: Jun. 30, 2009

(54) CONNECTOR WITH SECURELY LOCKABLE FRONT MASK

(75) Inventor: Masaki Mizutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/975,794

(22) Filed: Oct. 22, 2007

(65) Prior Publication Data

US 2008/0100306 A1 May 1, 2008

(30) Foreign Application Priority Data

Oct. 26, 2006 (JP) ..... 2006-290665

(51) Int. Cl.
*H01R 13/502* (2006.01)

(52) U.S. Cl. ..... 439/686

(58) Field of Classification Search ..... 439/686, 439/689, 579, 752, 752.5
See application file for complete search history.

(56) References Cited

U.S. PATENT DOCUMENTS 4,867,711 A * 9/1989 Yuasa ..... 439/752
4,944,688 A * 7/1990 Lundergan ..... 439/752
5,037,336 A * 8/1991 Betsui ..... 439/752
5,118,311 A * 6/1992 Margini ..... 439/676
5,464,356 A * 11/1995 Nebeshima et al. ..... 439/752
5,820,417 A * 10/1998 Yamada ..... 439/686
5,855,493 A * 1/1999 Shelly ..... 439/465
5,997,359 A * 12/1999 Picaud et al. ..... 439/686
6,179,671 B1 * 1/2001 Ohsumi ..... 439/752
6,332,803 B1 * 12/2001 Matsuda et al. ..... 439/488
6,575,788 B2 * 6/2003 Nimura et al. ..... 439/595
6,607,401 B1 * 8/2003 Weaver et al. ..... 439/608
6,749,461 B2 * 6/2004 Ishikawa et al. ..... 439/595
2002/0076995 A1 6/2002 Kurimoto et al.
2006/0170429 A1 8/2006 Nakamura et al.
2007/0046293 A1 3/2007 Nakamura et al.

* cited by examiner

*Primary Examiner*—Harshad C. Patel
(74) *Attorney, Agent, or Firm*—Gerald E. Hespos; Anthony J. Casella

(57) ABSTRACT

A connector housing (10) has a front surface with projecting walls that form a groove (31). A front mask (60) is mountable at a mount position on the front surface of the housing (10). The front mask (60) has a fittable portion (62) that fits the groove (31) when the front mask (60) is at the mount position. Latches (35) are formed on the inner surfaces of the projecting walls facing the groove (31), and engaging projections (77) are provided on side surfaces of the fittable portion (62) facing the inner surfaces of the projecting walls. The engaging projections (77) and the latches (35) resiliently engage to hold the front mask (60) at the mount position. Engaged areas of the engaging portions (77) and the latches (35) face the front ends of the projecting walls.

8 Claims, 6 Drawing Sheets

CONNECTOR WITH SECURELY LOCKABLE FRONT MASK

BACKGROUND OF THE INVENTION

1. Field of the Invention

The invention relates to a connector.

2. Description of the Related Art

U.S. Patent Application Publication No. 2006/0170429 discloses a connector with a housing that has cavities for receiving terminal fittings. Locks are formed in the cavities for locking the terminal fittings in the cavities. A front mask is mounted on the front surface of the housing to cover mold removal spaces that are left upon forming locks. The front mask protects the locks and enables mating terminal fittings to be inserted smoothly through the front mask.

This front mask is movable along the front surface of the housing, and is held on the housing upon reaching a mount position. Left and right projecting walls are formed on the front surface of the housing, and a groove is formed between the projecting walls. The front mask has a wide main body and a narrow fitting at the upper edge of the main body. Shoulders are formed at the upper end of the main body and at opposite sides of the fitting. The shoulders contact the projecting walls and the fitting is fit into the groove when the front mask is at the mount position. Latches are recessed in the opposite left and right edges of the main body, and engaging portions project at opposite left and right edges of the front surface of the housing. The engaging portions engage the latches while thinner walls at the opposite lateral edges of the main body deform resiliently to hold the front mask at the mount position.

The main body of the front mask is formed over the entire width of the front surface of the housing except at the thinner walls to cover the openings of all the cavities arranged side by side in the width direction. The thinner walls tend to be weak. Thus, the latches and the engaging portions might not be held engaged due to weakened restoring forces.

The latches would be stronger if the engaging portions were on the inner surfaces of the projecting walls facing the groove. Thus, the projecting walls could be thicker than the thinner walls. However, the projecting wall would be several times thicker than the thinner walls, and therefore the latches would be too strong. Hence, the engaging portions would be settled due to pressure from the projecting walls when the front mask is mounted repeatedly. As a result, this design also would be unable to keep a satisfactory engaged state.

The invention was developed in view of the above situation and an object thereof is to improve overall operation of a connector.

SUMMARY OF THE INVENTION

The invention relates to a connector with a housing that has at least one cavity for accommodating at least one terminal fitting. A front mask can be moved along the front surface of the housing and can be held on the housing at a mount position. Projecting walls are provided at the front of the housing and at lateral sides of a groove and the front mask rests on the projecting walls at the mount position. The front mask includes a fittable portion between parts of the front mask that rest on the projecting walls. The fittable portion that fits into the groove at the mount position. Latches are provided at the inner surfaces of the projecting walls facing the groove and engaging portions are provided on the fittable portion to face the inner surfaces of the projecting walls. The engaging portions and the latches resiliently engage while the projecting walls are resiliently deformed to hold the front mask at the mount position.

Engaged areas of the engaging portions and the latches preferably are set to substantially face the front ends of the projecting walls.

The fittable portion of the front mask is fit into the groove of the housing when the front mask is moved along the front surface of the housing to reach the mount position. Additionally, the parts of the front mask at the opposite sides of the fittable portion rest on the projecting walls of the housing and the latches at the inner surfaces of the projecting walls resiliently engage the engaging portions at the side surfaces of the fittable portion. As a result, the front mask is held at the mount position. The projecting walls have a sufficient thickness for the front mask to rest thereon. Hence, they do not become so much weaker even if resiliently deformed upon engaging the latches and the engaging portions. On the other hand, engaged areas of the latches with the engaging portions face the front ends of the projecting walls. Thus, the projecting walls deform more easily and there is no likelihood of considerably increasing pressures exerted to the engaging portions from the projecting walls as compared to the case where engaged areas are at the back sides of the inner surfaces of the projecting walls. This can prevent the latches and the engaging portions from being settled. As a result, the smoothness of the resilient deformations of the projecting walls can be ensured and the latches and the engaging portions can be held engaged satisfactorily.

Structures for retaining the front mask preferably are provided on the rear surface of the front mask and the front surface of the housing. Thus, the front mask can be held in the housing with an increased force. Further, the retaining structures on the rear surface of the front mask and the front surface of the housing are not exposed on the front surface of the front mask. Thus, the front mask will not be unlocked inadvertently.

An engaging projection preferably is provided at the front mask and can fit into an engaging recess of the housing as the front mask reaches the mount position.

Lateral restricting walls stand on widthwise ends of the engaging projection. The restricting wall is comprised of a first restricting wall extending substantially along forward and backward directions and a second restricting wall extending at an angle to forward and backward directions. Thus, loose widthwise movements of the front mask may be restricted by fitting the first restricting walls into corresponding parts of the engaging recess and loose forward and backward movements of the front mask may be restricted by fitting the second restricting walls into corresponding parts of the engaging recess.

The lateral restricting walls preferably are substantially L-shaped.

Projecting pieces preferably project from the side projecting walls towards the groove and preferably include the latches.

At least one mask-main-body retaining portion and at least one fittable-portion retaining portion are provided on the rear of the front mask and at least one retaining portion is provided on the front surface of the housing.

A lock arm preferably is provided on the housing main body and the projecting walls are formed by cutting off the base ends of the lock arm.

The front mask preferably is provided with tab insertion holes in positions corresponding to the cavities with the front mask at the mount position. Slanted tab guiding edges are formed substantially entirely around, the tab insertion holes in the front surface of the front mask.

These and other objects, features and advantages of the present invention will become more apparent upon reading of the following detailed description of preferred embodiments and accompanying drawings.

DETAILED DESCRIPTION OF THE PREFERRED EMBODIMENTS

A connector in accordance with the invention has a housing 10 that is connectable with a mating housing (not shown). A front mask 60 is mounted movably relative to the front surface of the housing 10. An end of the housing 10 to be connected with the mating housing is referred to as the front.

Figure 4:
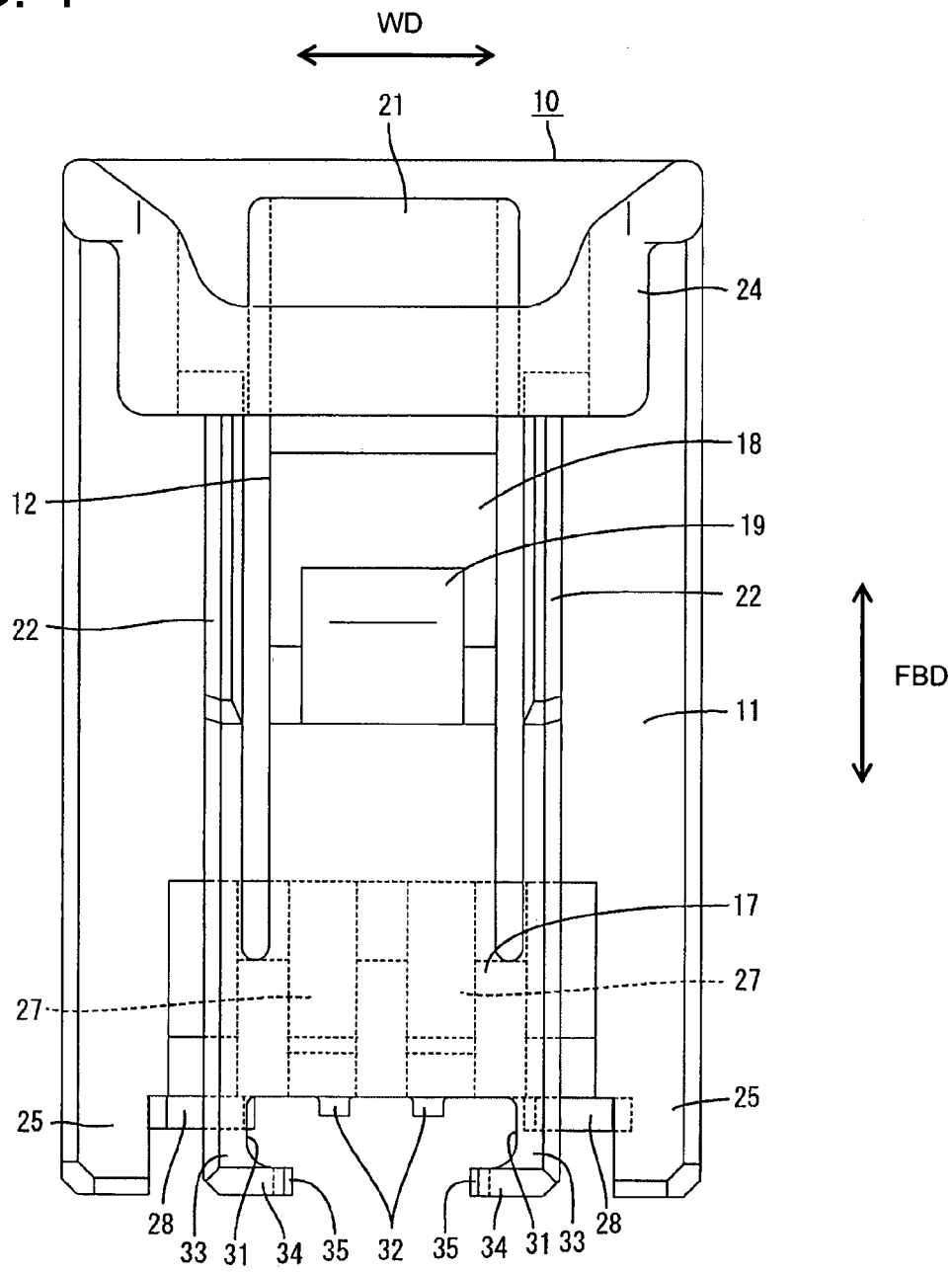
FIG. 4 is a plan view of a connector housing.
Figure 5:
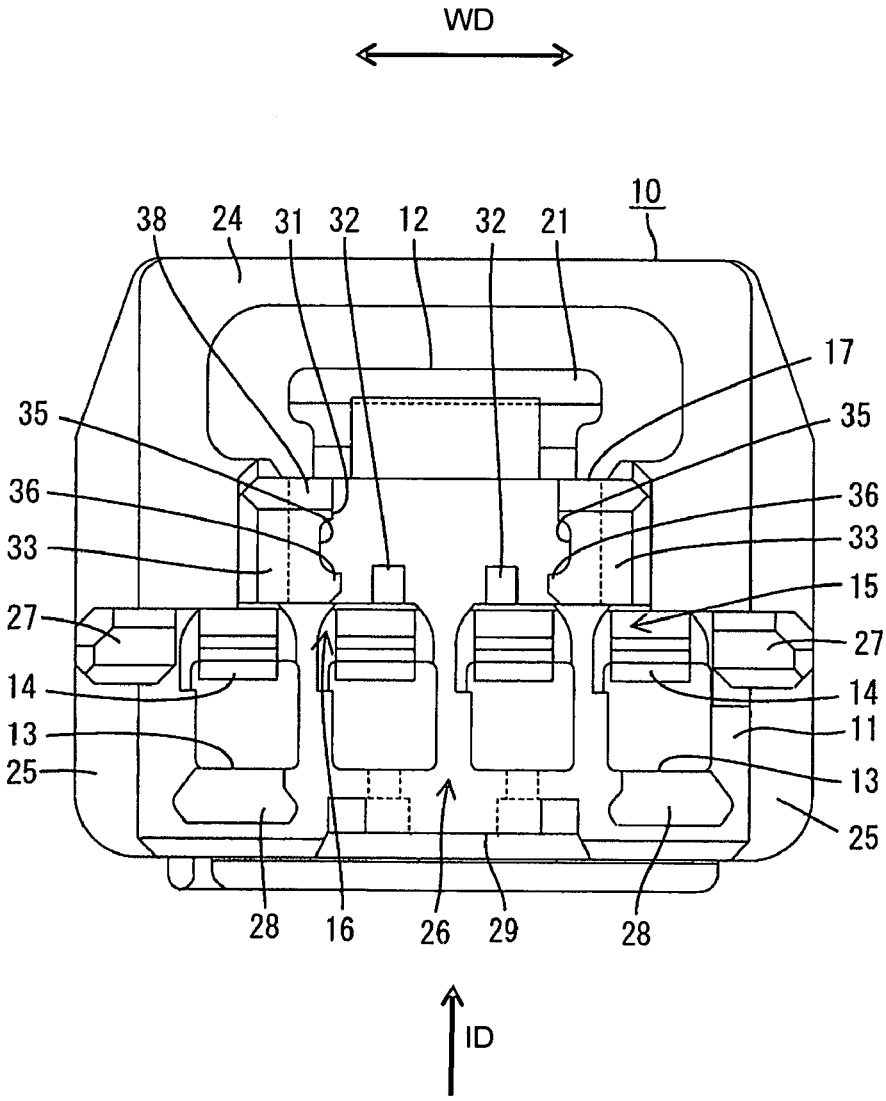
FIG. 5 is a front view of the connector housing.

The housing 10 is made e.g. of a synthetic resin and is substantially block-shaped. The housing 10 has a housing main body 11 that is substantially flat in a width direction WD. A lock arm 12 is provided at a widthwise intermediate position of the upper surface of the housing main body 11, as shown in FIGS. 4 and 5. Cavities 13 are arranged transversely side by side in the housing main body 11. A female terminal fitting (not shown) is insertable into each cavity 13 from behind, and an opening is made in the front connecting surface of the cavity 13 so that a tab of a mating male terminal fitting is insertable and withdrawable therethrough. A resiliently deformable lock 14 is formed at an inner surface of each cavity 13. Deformation spaces 15 for the locks 14 are defined in the housing main body 11, and a mold removal space 16 is left as the locks 14 are formed. The mold removal space 16 is formed in parts of the cavities 13 including the deformation spaces 15 and before the locks 14 to make openings in the front surface of the housing main body 11. Insertion of the female terminal fitting into the cavity 13 deforms the respective lock 14 towards the deformation space 15. The lock 14 resiliently restores to retain the female terminal fitting as the female terminal fitting is inserted properly.

The lock arm 12 has a base 17 that projects from the front end of the main body 11. An arm 18 is cantilevered back from the base 17 and a lock projection 19 projects from the upper surface of a longitudinal intermediate part of the arm 18. An operable portion 21 is formed near the free end of the arm portion 18 in such a manner as to be slightly elevated (projecting more outward). The lock projection 19 engages the mating housing as the lock arm 12 is restored resiliently to lock the two housings together. Further, the operable portion 21 is pressed to deform the lock arm 12 in an unlocking direction for separating the connected housings connected with each other.

This lock arm 12 is relatively large, and the base 17 thereof is substantially at the same height as the cavities 13. Additionally, the lock arm 12 has a height that is substantially the half the entire height of the connector if the operable portion 21 is included. The base end 17 of the lock arm 12 has a width that is substantially equal to or slightly larger than half the entire width of the connector. Protection walls 22 are formed on the upper surface of the housing main body 11 to stand up at substantially opposite sides of the arm 18. The protection walls 22 preferably have the front ends integrally or unitarily joined with the rear end surface of the base 17 and extend up to the vicinity of the operable portion 21. Further, a gate-shaped arch 24 is formed at the rear end of the upper surface of the housing main body 11 and surrounds the operable portion 21 of the lock arm 12. The arch 24 can prevent the operable portion 21 from getting caught by external matter, such as a looped wire, and can avoid an inadvertent unlocking operation to the operable portion 21. It should be noted that the structure of the base 17 of the lock arm 12 is described in detail later.

The mold removal space 16 is left in the front surface of the housing main body 11 before the front mask 60 is mounted, and the locks 14 are exposed therein. Left and right guiding walls 25 project from the opposite lateral edges of the front surface of the housing main body 11 to partition the mold removal space 16 from the opposite sides. A mount space 26 is defined between the guiding walls 25 and can receive the front mask 60. The front mask 60 is insertable into the mold removal space 16 in an inserting direction ID that intersects the forward and backward directions FBD from below. Widthwise or lateral loose movements of the front mask 60 in directions intersecting the inserting direction ID are restricted by the one or more guiding walls 25, whereas vertical movements along the inserting direction ID are guided. Housing-main-body projecting walls 27 are provided near the upper ends of the guiding walls 25 and project slightly towards the mount space 26. The housing-main-body projecting walls 27 are designed to let the front mask 60 rest thereon and restrict shaking movements of the front mask 60 about its longitudinal axis. Further, eave-shaped left and right main-body side retainers 28 are formed on the front surface of the housing main body 11 to project substantially along the bottom edges of the cavities at the opposite widthwise ends. An engaging recess 29 is formed at a widthwise intermediate part of the bottom edge of the housing main body 11 and is engageable with the bottom end of the front mask 60. The engaging recess 29 and the main-body side retainers 28 are covered by the front mask 60 after the front mask 60 is mounted.

The front end surface of the base 17 of the lock arm 12 is located more forward than the front end of the main body 11, and an open mount space 26 is below the front part of the base 17 of the lock arm 12. A groove 31 penetrates a widthwise intermediate area of the front part of the base 17 substantially in vertical direction. The bottom surface of the groove 31 is substantially flush and continuous with the front surface of the main body 11. Left and right lock-arm side retainers 32 are formed on the bottom surface of the groove 31 to project substantially along the upper edges of the cavities 13 of the main body 11. Similar to the main-body side retainers 28, the lock-arm side retainers 32 are covered by the front mask 60 after the front mask 60 is mounted, and a projecting amount of the lock-arm side retainers 32 is less than that of the main-body side retainers 28.

Left and right lock-arm side projecting walls 33 are provided at the front portion of the base 17 of the lock arm 12 and at the opposite sides of the groove 31. First shoulders 63 of the front mask 60 contact the lock-arm side projecting walls 33 from below and along the inserting direction ID as the front mask 60 is mounted in the inserting direction ID. The bottom edges of the lock-arm side projecting walls 33 are substantially at the same height as the upper edges of the main-body side projecting walls 27. Additionally, the bottom edges of the lock-arm side projecting walls 33 are substantially horizontal and constitute the upper edge of the mount space 26. The inner surfaces of the lock-arm side projecting walls 33 constitute groove surfaces and face the groove 31. Left and right projecting pieces 34 project in and towards each other from the front ends of the inner surfaces of the projecting pieces 34. The inner rear surfaces of base ends of the projecting pieces 34 are curved so that the base ends of the projecting pieces 34 are thicker than the leading ends thereof.

The leading ends of the projecting pieces 34 are recessed at positions facing the front ends of the lock-arm side projecting walls 33 to form exposed latches 35. The latches 35 have substantially bowl shapes whose openings are facing substantially normal to the inserting direction ID of the front mask 60, and are engageable with engaging projections 77 of the front mask 60. Slanted guiding edges 36 are formed at the bottoms of the leading ends of the projecting pieces 34, and the engaging projections 77 of the front mask 60 can be held in sliding contact with the guiding edges 36 in the process of mounting the front mask 60. It should be noted that beveling 38 is applied to the lock-arm side projecting walls 33 and the main-body side projecting walls 27 except inner edges facing the mount space 26 and the groove 31.

Figure 6:
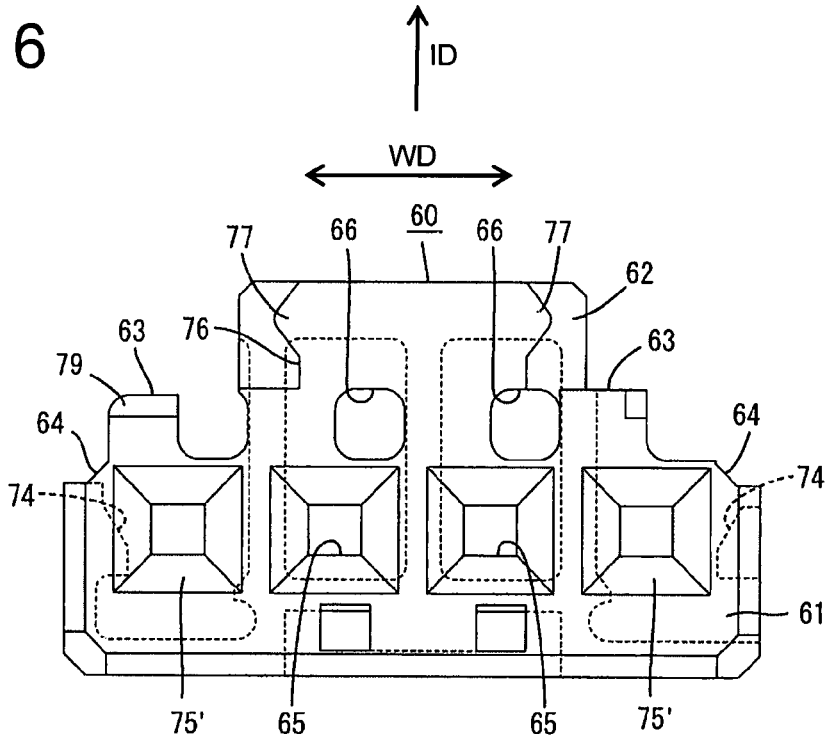
FIG. 6 is a front view of a front mask.
Figure 7:
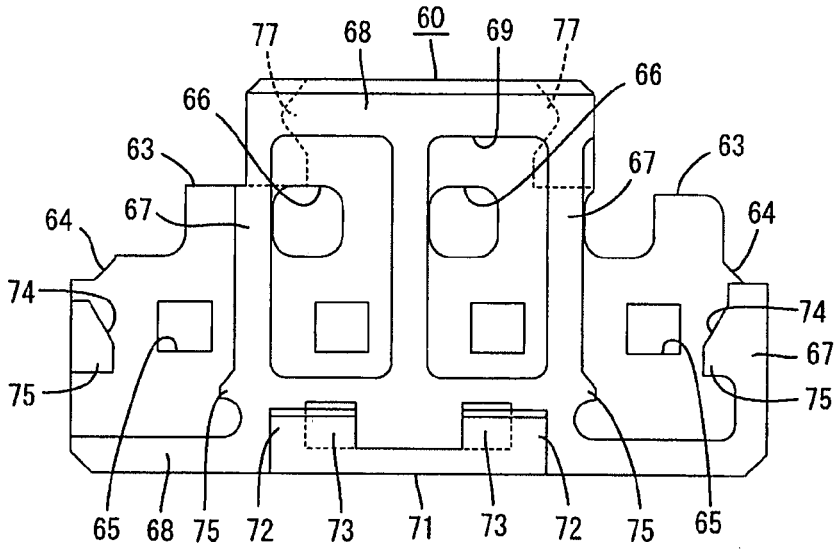
FIG. 7 is a rear view of the front mask.

The front mask 60 is made e.g. of a synthetic resin in the form of a substantially flat plate and is insertable into the mount space 26 of the main body 11 from below for movement substantially vertically along the inserting direction ID on the front surface of the housing main body 11. Specifically, as shown in FIGS. 6 and 7, the front mask 60 includes a wide mask main body 61 that can face the housing main body 11 and a narrow fittable portion 62 that is fittable into the groove 31. The fittable portion 62 projects at an intermediate position of the upper edge (front edge as seen in the inserting direction ID) of the mask main body 61. Parts of the upper edge of the mask main body 61 excluding the fittable portion 62 define first and second shoulders 63, 64 that can contact the lock-arm side projecting walls 33 and the main-body side projecting walls 27 from below. More specifically, the first shoulders 63 are provided on the front side of the mask main body 61 with respect to the inserting direction ID and adjacent to the fittable portion 62. The first shoulders 63 can contact the respective lock-arm side projecting walls 33. The second shoulders 64 are at the opposite widthwise ends and slope down towards the opposite lateral edges at positions lower (or more backward with respect to the inserting direction ID) than the first shoulders 63. Thus, the first shoulders 63 are arranged at about 90° with respect to the inserting direction ID and the second shoulders 64 are inclined with respect to the inserting direction ID.

Tab insertion holes 65 are formed in a transverse row in the mask main body 61 and can communicate with the respective cavities 13. Slanted tab guiding edges 75' are formed substantially entirely around the tab insertion holes 65 in the front surface of the mask main body 61. The mask main body 61 also is formed with jig insertion holes 66 in a transverse row offset from the respective tab insertion holes 65 in the width direction WD. An electrically connected state of the female terminal fitting in the cavity 13 is checked by inserting a probe pin (not shown) into the jig insertion hole 66 when the front mask 60 is at a non-mount position offset below a proper mount position.

Spaced apart vertical ribs 67 are formed on the rear surface of the front mask 60 facing the housing main body 11 and extend from the mask main body 61 to the fittable portion 62. The ribs 67 can abut partition walls 39 at opposite sides of the cavities 13 of the housing main body 11. The front ends of the female terminal fittings fit between the respective vertical ribs 67 for positioning in the width direction WD. Further, upper and lower horizontal ribs 68 connect the upper and lower ends of the vertical ribs 67 near the bottom of the rear surface of the mask main body 61 and the top of the rear surface of the fittable portion 62. The upper horizontal rib 68 defines a fittable-portion side retainer 69 and is resiliently engageable with the lock-arm side retainers 32. The front mask 60 is prevented from coming off in a downward direction by the contact of the lower edge of the fittable-portion side retainer 69 and the upper edges of the lock-arm side retainers 32.

An engaging projection 71 projects back towards the main body 11 from the bottom edge of the rear surface of the mask main body 61 and is fit into the engaging recess 29 of the housing main body 11 as the front mask 60 reaches the mount position. Left and right substantially L-shaped walls stand on opposite widthwise ends of the upper surface of the engaging projection 71. Each L-shaped wall has a first restricting wall 72 extending substantially along forward and backward directions FBD and a second restricting wall 73 extending substantially along the width direction WD and substantially normal to the forward and backward directions FBD. Loose widthwise movements of the front mask 60 are restricted by fitting the first restricting walls 72 into corresponding parts of the engaging recess 29 and loose forward and backward movements of the front mask 60 are restricted by fitting the second restricting walls 73 into corresponding parts of the engaging recess 29.

Mask-main-body side retainers 74 are provided at opposite sides of the rear surface of the mask main body 61 and are resiliently engageable with the respective housing-main-body side retainers 28. Each mask-main-body side retainer 74 has left and right claws 75 substantially facing each other, and the claw 75 located at the inner side is joined unitarily with the corresponding vertical rib 67. The front mask, 60 is prevented from coming off downward by engaging the respective claws 75 with the corresponding housing-main-body side retainers 28 from the opposite widthwise sides.

The opposite widthwise sides of the front part of the fittable portion 62 are formed to define projecting-piece entrance recesses 76 and engaging projections 77. The projecting-piece entrance recesses 76 permit entry of the projecting pieces 34 of the lock arm 12. The engaging projections 77 are above the projecting-piece entrance recesses 76 of the fittable portion 62 and fit into the latches 35 of the lock arm 12 as the front mask 60 reaches the mount position. The engaging projections 77 have substantially triangular cross sections and are formed over substantially the entire widths of the projecting-piece entrance recesses 76 in forward and backward directions FBD. Upper and lower edges of the engaging portions are inclined to come closer towards the leading ends. The base ends of the upper edges of the engaging projections 77 are connected with the upper end of the fittable portion 62. It should be noted that the engaging projections 77 and the mask-main-body side retaining portions 74 preferably are offset so as not to overlap in the moving inserting direction ID of the front mask 60. Further, the outer edges of the front mask 60 are beveled to form slanted edges 79.

Figure 1:
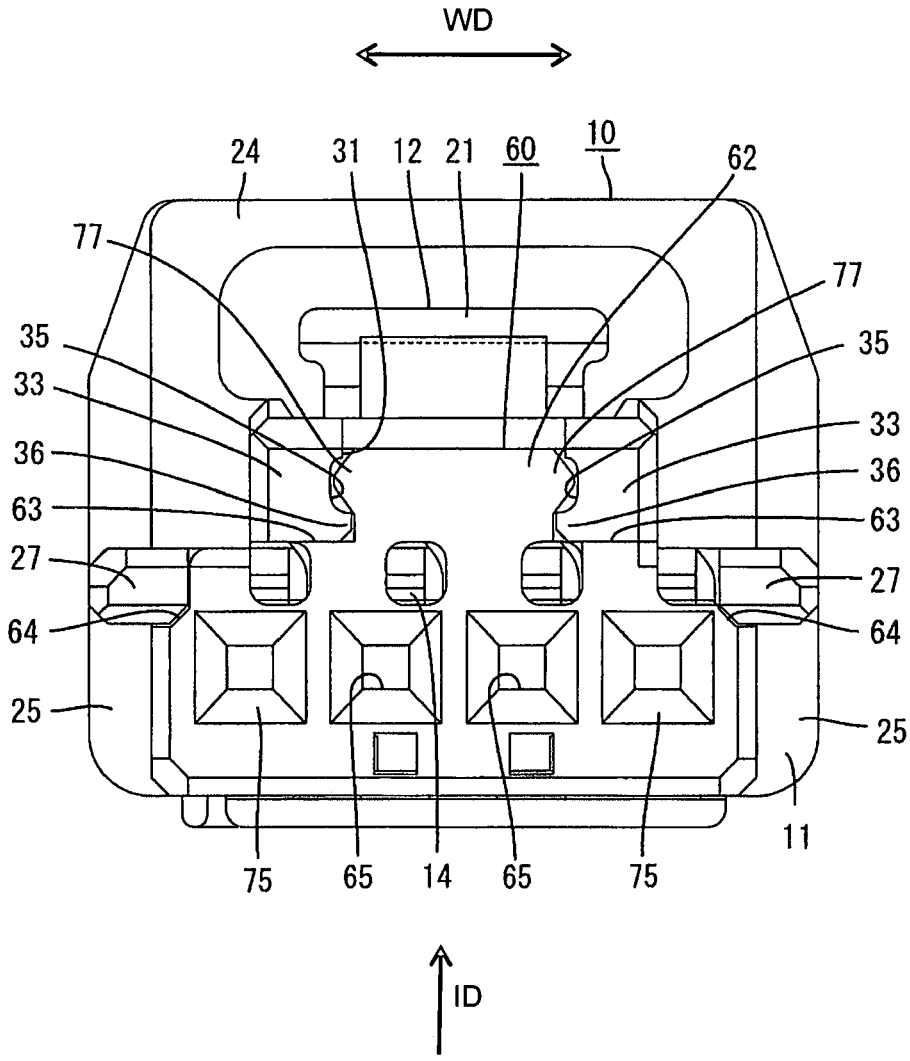
FIG. 1 is a front view of a connector according to one embodiment.
Figure 2:
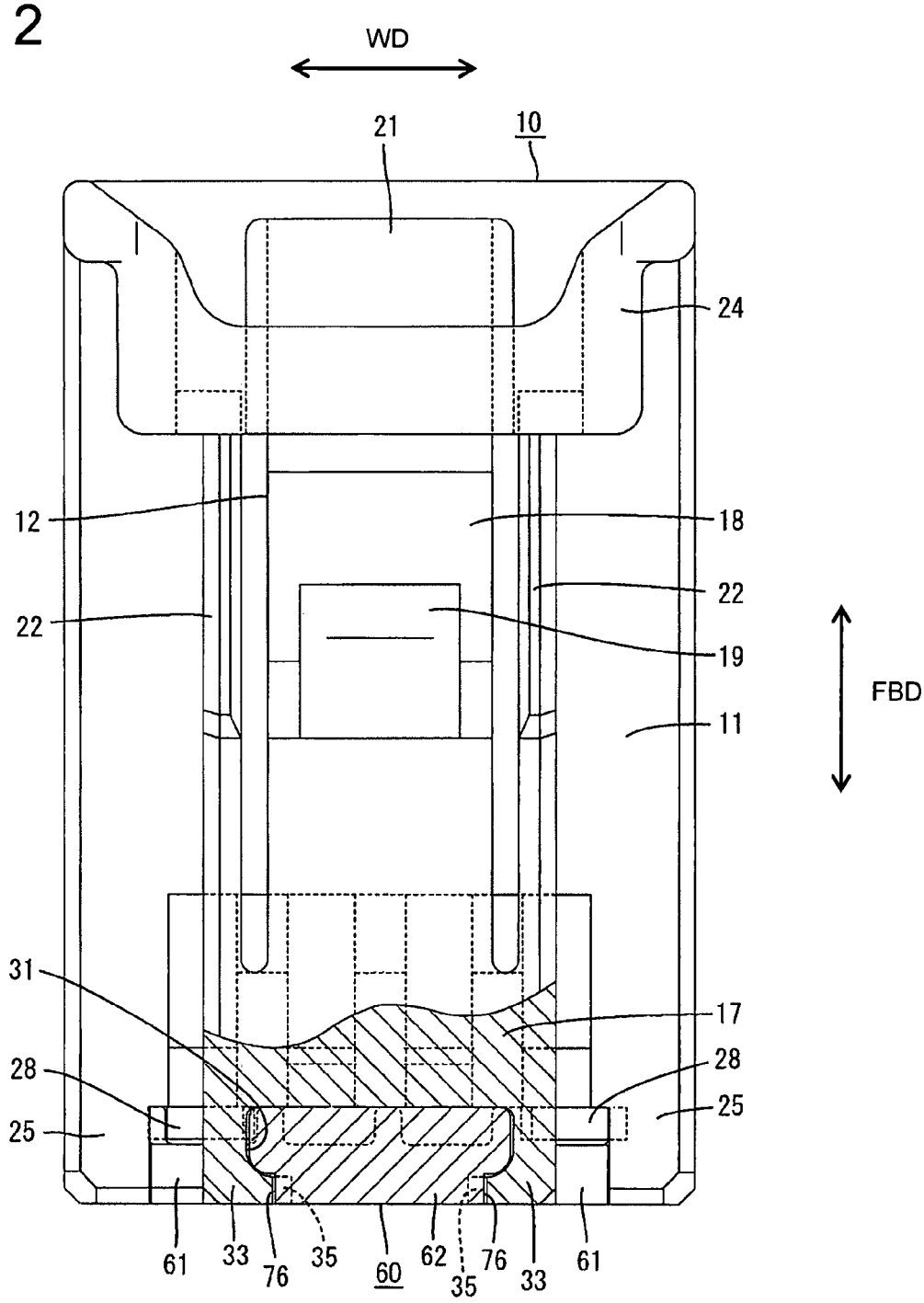
FIG. 2 is a plan view partly in section of the connector.
Figure 3:
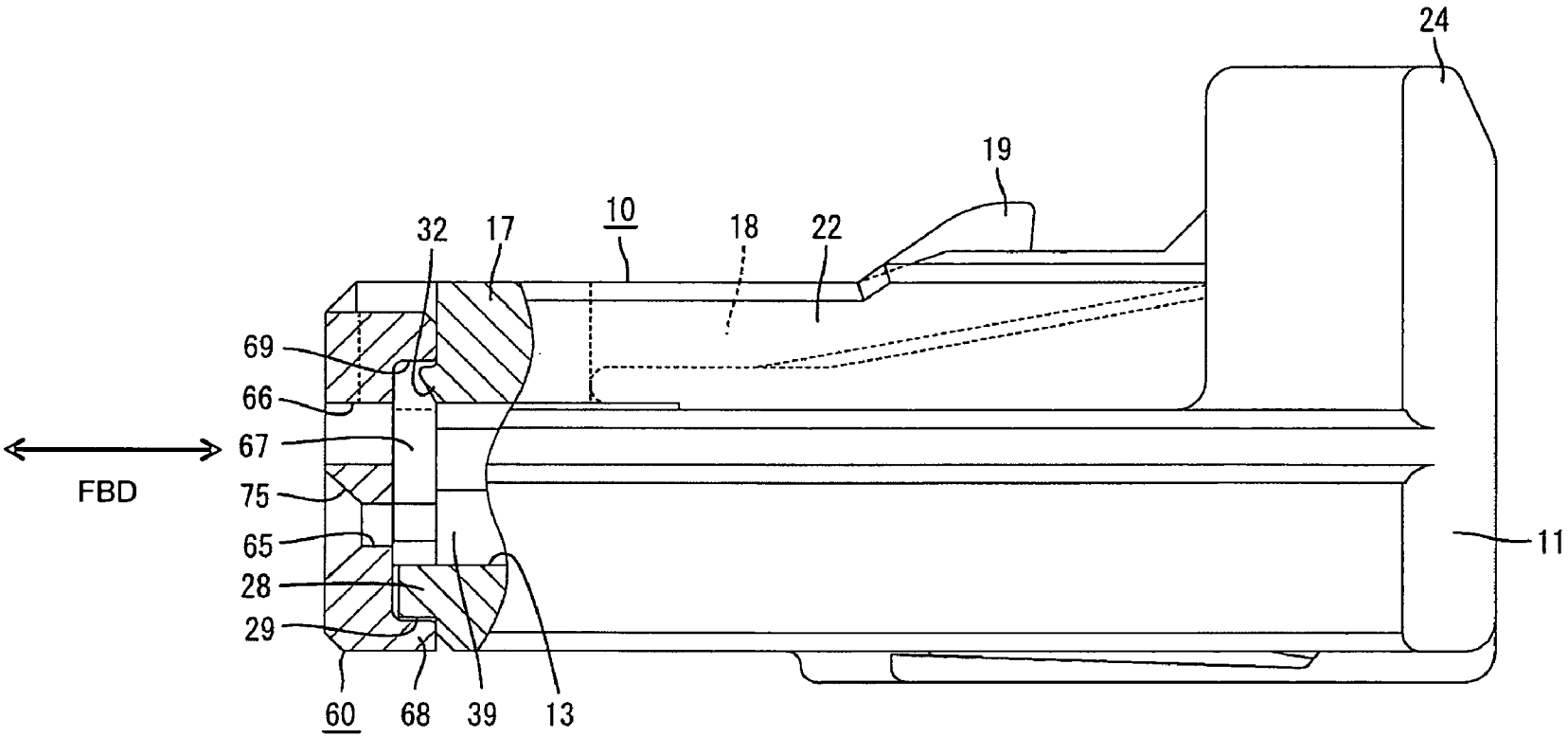
FIG. 3 is a side view partly in section of the connector.

The front mask 60 is mounted into the mount space 26 of the housing 10 from below and along the inserting direction ID. Thus, opposite widthwise side edges of the mask main body 61 slide in contact with the inner surfaces of the guiding walls 25 of the housing main body 11 to guide the mounting of the front mask 60. The fittable portion 62 enters the groove 31 of the lock arm 12 from below and along the inserting direction ID during a final stage of the mounting operation. At the start of this entrance, the engaging projections 77 of the fittable portion 62 slide in contact with the guiding edges 36 of the projecting pieces 34 of the lock arm 12 of the front mask 60. Thus, the lock-arm side projecting walls 33, including the projecting pieces 34 resiliently deform away from the front mask 60 and away from each other. The front mask 60 is pushed up further in this state. As a result, the engaging projections 77 move over and beyond the guiding edges 36 and the lock-arm side projecting walls 33 resiliently restore. Thus, the engaging projections 77 and the latches 35 are engaged for locking in an exposed state at the front ends of the lock-arm side projecting walls 33. The first shoulders 63 of the mask main body 61 contact the lock-arm side projecting walls 33 from below and along in the inserting direction ID, and the second shoulders 64 of the mask main body 61 contact the housing-main-body side projecting walls 27 from below and along the inserting direction ID, as shown in FIGS. 1 and 2. As a result further upward movement of the front mask 60 is restricted.

At the mount position, the claws 75 of the mask-main-body side retainers 74 resiliently engage the corresponding housing-main-body side retainers 28, the fittable-portion side retainers 69 resiliently engage the lock-arm side retainers 32 and the engaging projection 71 of the mask main body 61 fits in the engaging recess 29 of the housing main body 11 from below and along the inserting direction ID. As a result, the front mask 60 is held reliably. When the front mask 60 is at the mount position, the upper end surface of the fittable portion 62 is below the upper end surfaces of the lock-arm side projecting walls 33 and the front surface of the front mask 60 is substantially flush with front end surfaces of the lock-arm side projecting walls 33 and the housing-main-body side projecting walls 27.

The female terminal fittings are inserted into the cavities 13 from behind and are locked resiliently by the locks 14. The mating housing then is fit from the front. As a result, tabs of the male terminal fittings mounted in the mating housing are guided through the tab insertion holes 65 of the front mask 60 and into the cavities 13 for electrical connection with the respective female terminal fittings in the cavities 13. The tabs are could be displaced from proper positions due to a positioning error between the two housings. However, the displacements of the tabs will be corrected by the guiding edges of the front mask 60 or the tabs will contact the front surface of the front mask 60. Accordingly, the tabs are prevented from entering the cavities 13 in improper postures. The lock arm 12 is engaged resiliently with the mating housing when the two housings are connected properly. Thus, the two housings are locked in an engaged state.

The engaging projections 77 of the front mask 60 engage the latches 35 of the housing 10 while the lock-arm side projecting walls 33 are deformed resiliently for holding the front mask 60 in the housing 10 at the mount position. There is a possibility that the lock-arm side projecting walls 33 will become weaker after repeated use, and will not keep a sufficient locking strength. However, the lock-arm side projecting walls 33 have such rigidity to let the front mask 60 rest thereon. Hence, the lock-arm side projecting walls 33 do not become so much weaker and can sufficiently endure repeated use. The rigidity of the lock-arm side projecting walls 33 is high and the engaging projections 77 might be settled due to pressures from the lock-arm side projecting walls 33 if areas where the engaging projections 77 and the latches 35 engage were at the back sides of the inner surfaces of the projecting walls (rear sides of the surfaces of the groove 31). However, the engaged areas of the latches 35 and the engaging projections 77 face the front ends of the inner surfaces of the lock-arm side projecting walls 33. Thus, the ease of resiliently deforming the lock-arm side projecting walls 33 is not impaired and the settlement of the engaging projections 77 is prevented. As a result, the lock-arm side projecting walls 33 deform smoothly and the latches 35 and the engaging projections 77 are engaged satisfactorily to improve overall operability.

The projecting pieces 34 of the lock-arm side projecting walls 33 project towards the groove 31 and the projecting pieces 34 include the latches 35. Thus, the lock-arm sides projecting walls 33 can be deformed more smoothly by adding the resilient deformations of the projecting pieces 34.

The mask-main-body side retainers 74 and the fittable-portion side retainers 69 are on the rear surface of the front mask 60 facing the housing main body 11 and the housing-main-body side retainers 28 and the lock-arm side retainers 32 are on the front surface of the housing 10 facing the front mask 60. Thus, the locking structure defined by the latches 35 and the engaging projections 77 is improved and the front mask 60 is held on the housing 10 with an increased force by these retaining structures. Further, these retaining structures on the rear surface of the front mask 60 and the front surface of the housing 10 are not exposed on the front surface of the front mask 60 and, hence, prevent the front mask 60 from being unlocked inadvertently.

The lock-arm side projecting walls 33 are formed by cutting off the base ends 17 of the existing lock arm 12. Thus, the construction of the entire connector can be simplified and the length of the connector in forward and backward directions can be shorter as compared to the case where the lock-arm side projecting walls 33 are provided separately at different positions.

The invention is not limited to the above described and illustrated embodiments. For example, the following embodiments are also embraced by the technical scope of the present invention as defined by the claims.

The projecting walls and the groove may be formed at a part of the housing other than the lock arm.

The lock arm may have both front and rear ends supported on the housing (e.g. in a bridge-like manner).

The invention is also applicable in the case where the latches project from the inner surfaces of the projecting walls and the engaging portions are formed by recessing the side surfaces of the fittable portion.

The invention is also applicable to a front mask moved in the width direction to rest on a projecting wall at one lateral edge of the housing.

What is claimed is:

1. A connector, comprising:

a housing with a main body having opposite front and rear ends and opposite top and bottom surfaces, first and second spaced apart guide walls projecting forward at the front end of the main body, first and second main body projecting walls formed at the front end of the main body and substantially adjacent the top surface of the main body, the first and second main body projecting walls projecting towards one another from the respective first and second guide walls, a mount space being defined at the front end of the main body between the guide walls, cavities extending through the main body between the rear end and the mount space for accommodating terminal fittings, the cavities being at positions between the top and bottom surfaces, a lock arm projecting from the top surface of the main body, lock-arm side projecting walls projecting up at positions on the housing above the mount space and aligned substantially with opposite respective sides of the lock arm, a spacing between the lock-arm side projecting walls being less that a spacing between the guide walls, and a groove being defined between the lock-arm side projecting walls, latches provided on the lock-arm side projecting walls and facing into the groove; and a front mask movable along the front end of the main body of the housing towards a mount position, the front mask including a main body with tab insertion holes that align respectively with the cavities when the front mask is in the mount position, the front mask further including a fittable portion that fits in the groove as the front mask is moved towards the mount position, shoulders formed on the main body and projecting transversely of the fittable portion, the shoulders resting against the main body projecting walls when the front mask is at the mount position, engaging projections on the fittable portion and disposed for engaging the latches when the front mask is at the mount position for holding the front mask at the mount position.

2. The connector of claim 1, wherein at least part of at least one of the lock-arm side projecting walls is resiliently deformable for resiliently engaging the engaging projection for holding the front mask at the mount position.

3. The connector of claim 1, wherein engaged areas of the engaging projections and the latch are at projecting front ends of the side-arm side projecting walls.

4. The connector of claim 1, wherein the lock-arm side projecting walls are provided with projecting pieces projecting towards the groove, at least one of the projecting pieces including the latch.

5. The connector of claim 1, wherein slanted tab guiding edges are formed substantially entirely around the tab insertion holes in a front surface of the front mask.

6. The connector of claim 1, wherein the front mask has a rear surface facing towards the front end of the housing, locking structures being formed on the rear surface of the front mask and being engageable with locking structures projecting forward in the groove of the housing for holding the front mask at the mount position, whereby the locking structures are covered and protected by the front mask.

7. The connector of claim 1, wherein an engaging projection is provided on the front mask and is configured for fitting into an engaging recess of the housing substantially as the front mask reaches the mount position.

8. The connector of claim 1, wherein L-shaped restricting walls stand on widthwise sides of the engaging projection, each restricting wall having a first restricting wall extending substantially along forward and backward directions and a second restricting wall extending substantially along a width direction substantially normal to the forward and backward directions, whereby loose widthwise movements of the front mask are restricted by fitting the first restricting walls into corresponding parts of the engaging recess and loose forward and backward movements of the front mask are restricted by fitting the second restricting walls into corresponding parts of the engaging recess.

* * * * *